US012781359B2

(12) United States Patent
Schreiber et al.

(10) Patent No.: US 12,781,359 B2
(45) Date of Patent: Nov. 3, 2026

(54) $CO_2$ ELECTROREDUCTION TO MULTI-CARBON PRODUCTS IN ACIDIC CONDITIONS COUPLED WITH $CO_2$ REGENERATION FROM CARBONATE

(71) Applicants: TOTALENERGIES ONETECH, Courbevoie (FR); COLLÈGE DE FRANCE, Paris cedex (FR)

(72) Inventors: Moritz Wilhelm Schreiber, Seneffe (BE); Alessandro Perazio, Paris (FR); Marc Fontecave, Paris (FR); Charles E. Creissen, Manchester (GB)

(73) Assignees: TOTALENERGIES ONETECH, Courbevoie (FR); COLLÈGE DE FRANCE, Paris Cedex (FR)

( * ) Notice: Subject to any disclaimer, the term of this patent is extended or adjusted under 35 U.S.C. 154(b) by 0 days.

(21) Appl. No.: 19/118,631

(22) PCT Filed: Sep. 26, 2023

(86) PCT No.: PCT/EP2023/076572
§ 371 (c)(1),
(2) Date: Apr. 4, 2025

(87) PCT Pub. No.: WO2024/078866
PCT Pub. Date: Apr. 18, 2024

(65) Prior Publication Data

US 2026/0009143 A1 Jan. 8, 2026

(30) Foreign Application Priority Data

Oct. 13, 2022 (EP) ..... 22315237

(51) Int. Cl.
*C25B 3/26* (2021.01)
*C25B 3/03* (2021.01)
(Continued)

(52) U.S. Cl.
CPC ..... *C25B 3/26* (2021.01); *C25B 3/03* (2021.01); *C25B 3/07* (2021.01); *C25B 9/19* (2021.01); *C25B 11/032* (2021.01); *C25B 15/08* (2013.01)

(58) Field of Classification Search
None
See application file for complete search history.

(56) References Cited

U.S. PATENT DOCUMENTS

2020/0080211 A1 3/2020 Schmid et al.

FOREIGN PATENT DOCUMENTS

WO 2019051609 A1 3/2019

OTHER PUBLICATIONS

International Search Report and Written Opinion issued in Application No. PCT/EP2023/076572, dated Mar. 25, 2024, 10 pages.
(Continued)

*Primary Examiner* — Wojciech Haske
(74) *Attorney, Agent, or Firm* — Ewing & Jones, PLLC

(57) ABSTRACT

The disclosure relates to a process for electrolysing carbon dioxide using a gas-fed flow cell comprising a gas diffusion electrode comprising a metal-based catalyst, wherein the catholyte flow is an acidic catholyte flow comprising one or more alkali metal cations, wherein the gas-fed flow cell comprises a bipolar membrane and wherein the acidic catholyte has a pH of at most 5.5 and the catholyte pH is less than the anolyte pH.

15 Claims, 5 Drawing Sheets

(51) Int. Cl.

| | |
|---|---|
| ***C25B 3/07*** | (2021.01) |
| ***C25B 9/19*** | (2021.01) |
| ***C25B 11/032*** | (2021.01) |
| ***C25B 15/08*** | (2006.01) |

(56) References Cited

OTHER PUBLICATIONS

Huang et al., "CO2 electrolysis to multicarbon products in strong acid", Science, 2021, 372, 1074-1078.

Y. Xie et al., "High carbon utilization in CO2 reduction to multicarbon products in acidic media", Nature Catalysis, 2022, 5, 564-570.

J. Gu et al., "Modulating electric field distribution by alkali cations for CO2 electroreduction in strongly acidic medium", Nature Catalysis, 2022, 5, pp. 268-276.

Vermaas David et al., "Synergistic Electrochemical CO2 reduction and Water Oxidation with Bipolar Membrane" ACS Energy Letters, vol. 1, No. 6, 2016, pp. 1143-1148.

Z. Shan Hong, et al., "A convenient alcohothermal approach for low temperature synthesis of CuO nanoparticles", Mater. Lett. 2002, 52, pp. 34-38.

T. K. Todorova, et al., "Mechanistic Understanding of CO2 Reduction Reaction (CO2RR) Toward Multicarbon Products by Heterogeneous Copper-Based Catalysts", ACS Catal. 2020, 10, 1754-1768.

$CO_2$ ELECTROREDUCTION TO MULTI-CARBON PRODUCTS IN ACIDIC CONDITIONS COUPLED WITH $CO_2$ REGENERATION FROM CARBONATE

CROSS-REFERENCE TO RELATED APPLICATIONS

This application claims the benefit of PCT/EP2023/076572 filed Sep. 26, 2023, which claims priority from EP 22315237.2 filed Oct. 13, 2022, which are incorporated herein by reference in their entireties for all purposes.

TECHNOLOGICAL FIELD

The present disclosure relates to processes and systems comprising a gas-fed flow cell for electrochemical carbon dioxide reduction, for example, to upgrade greenhouse gases such as carbon dioxide to valuable fuels and feedstocks.

TECHNOLOGICAL BACKGROUND

Electrochemical carbon dioxide reduction ($CO_2R$) offers a sustainable route to generate valuable chemical products from $CO_2$ and renewable electricity sources. Recent progress has brought $CO_2R$ closer to commercial viability through the development of devices that overcome the severe limitations of mass transport arising from the low solubility of $CO_2$ in aqueous solutions. One example is the gas-fed flow cell, in which the $CO_2$ is supplied as a gas through the back of a gas-diffusion electrode (GDE) in contact with a flowing electrolyte solution. These devices can regularly attain high current densities (hundreds of mA $cm^{-2}$) at low overpotentials (<1 V). However, the common use of alkaline or neutral pH electrolyte solutions has prohibited high conversion yields due to the unwanted reaction of $CO_2$ with hydroxide ions, which results in reactant loss through the formation of (bi)carbonate (FIG. 3*a*).

These species can be externally converted back to $CO_2$, but the regeneration process accounts for more than half of the energy required for the electrolyser in the case of an alkaline flow cell.

The problem can be partly addressed by using acidic electrolyte solutions where the pH is below the pKa of bicarbonate formation. In such systems, while the $CO_2$ is still converted to (bi)carbonate (Eq. 1 and Eq. 2) by the alkaline local pH at the cathode arising from hydroxide ions generated during $CO_2$ reduction (Eq. 3), these (bi) carbonate species are immediately converted back to $CO_2$ (termed r-$CO_2$ as this is regenerated) due to the low bulk pH (Eq. 4). (FIG. 3*b*). This provides the possibility to recycle and re-react the r-$CO_2$, which maximizes the conversion yield of the $CO_2R$ since all the reactant is ultimately converted into reduction products and is not permanently lost as (bi) carbonate.

$$CO_2 + OH^- \rightleftharpoons HCO_3^- \quad \text{Equation 1}$$

$$HCO_3^- + OH^- \rightleftharpoons CO_3^{2-} + H_2O \quad \text{Equation 2}$$

$$CO_2 + H_2O + 2e^- \rightleftharpoons CO + 2\ OH^- \quad \text{Equation 3}$$

$$HCO_3^- + H^+ \rightleftharpoons r - CO_2 + H_2O \quad \text{Equation 4}$$

However, a major fraction of input $CO_2$ is consumed by the electrolyte through reactions with the hydroxide to form carbonate/bicarbonate in both alkaline and neutral reactors. Acidic routes for $CO_2R$ have been studied to overcome this limitation. However, it was found that the acidic route also promotes the hydrogen evolution reaction (HER).

X. Huang et al., in *Science,* 2021, 372, 1074-1078 report that concentrating potassium cations in the vicinity of electrochemically active sites accelerates $CO_2$ activation to enable efficient $CO_2R$ in acid. $CO_2R$ was achieved on copper at pH<1 with a single-pass $CO_2$ utilization of 77%, including a conversion efficiency of 50% toward multicarbon products (ethylene, ethanol, and 1-propanol) at a current density of 1.2 amperes per square centimeter and a full-cell voltage of 4.2 volts.

Y. Xie et al., in *Nature Catalysis,* 2022, 5, 564-570, report a design strategy that suppresses hydrogen evolution reaction activity by maximizing the co-adsorption of CO and $CO_2$ on Cu-based catalysts to weaken H* binding. Using density functional theory studies, it was found Pd—Cu promising for selective $C_{2+}$ production over $C_1$, with the lowest $\Delta G_{OCCOH*}$ and $\Delta G_{OCCOH*}$-$\Delta G_{CHO*}$. Pd—Cu catalysts were synthesized and reported a crossover-free system (liquid product crossover<0.05%) with a Faradaic efficiency of 89±4% for $CO_2$ to $C_{2+}$ at 500 mA $cm^{-2}$, simultaneous with single-pass $CO_2$ utilization of 60±2% to $C_{2+}$.

J. Gu et al., in *Nature Catalysis,* 2022, 5, 268-276, show that by suppressing the otherwise predominant hydrogen evolution using alkali cations, efficient $CO_2$ electroreduction can be conducted in an acidic medium, overcoming the carbonate problem. The cation effects are general for three typical catalysts including carbon-supported tin oxide, gold, and copper, leading to Faradaic efficiency of as high as 90% for formic acid and CO formation. The analysis suggests hydrated alkali cations physisorbed on the cathode modify the distribution of electric field in the double layer, which impedes hydrogen evolution by suppressing the migration of hydronium ions while at the same time promoting $CO_2$ reduction by stabilizing key intermediates.

Although the above techniques are promising, there is still room for improvement. For example, the use of proton exchange membranes leads to a crossover of metal ions, cationic electrolyte species, and products, which can negatively impact device performance and stability over long durations. The use of acidic anolytes requires acid-tolerant oxygen evolution reaction (OER) catalysts based on precious metals such as Ir or Ru, which increase the costs involved.

WO2019/051609 discloses processes and apparatus for electrocatalytically reducing carbon dioxide are described. The process may include: providing a gas containing carbon dioxide at a cathode of an electrolytic cell comprising a membrane electrode assembly which includes a bipolar membrane separating an anode from the cathode. A support layer containing water is located between the bipolar membrane and the cathode. An electrical potential difference between the cathode and the anode of the membrane electrode assembly electrocatalytically reduces the carbon dioxide to carbon monoxide or another useful chemical. The support layer facilitates stable operating at higher current densities.

US2020/080211 discloses an electrolysis cell comprising: a cathode space housing a cathode; a first ion exchange membrane including an anion exchanger and adjoining the cathode space; an anode space housing an anode; a second ion exchange membrane including a cation exchanger and adjoining the anode space; and a salt bridge space disposed between the first ion exchange membrane and the second ion exchange membrane. The cathode comprises: a gas diffusion electrode having a porous bound catalyst structure of a particulate catalyst on a support; a coating of a particulate catalyst on the first and/or second ion exchange membrane; and a porous conductive support impregnated with a catalyst.

Vermaas David et al. «Synergistic Electrochemical CO2 reduction and Water Oxidation with Bipolar Membrane" (DOI: 10.1021/acsenergylett.6b00557) reads that the electrochemical conversion of $CO_2$ and water to value-added products still suffers from low efficiency, high costs, and high sensitivity to electrolyte, pH, and contaminants. Here, we present a strategy for this reaction using a silver catalyst for $CO_2$ reduction in a neutral catholyte, separated by a bipolar membrane from a nickel iron hydroxide oxygen evolution catalyst in a basic anolyte. This combination of electrolytes provides a favorable environment for both catalysts and shows the effective use of bicarbonate and KOH to obtain low cell voltages. This architecture brings down the total cell voltage by more than 1 V compared to that with conventional use of a Pt counter electrode and monopolar membranes, and at the same time, it reduces contamination and improves stability at the cathode.

There is still a need for improvement of processes and systems for efficient electrochemical carbon dioxide reduction ($CO_2R$) reactions.

SUMMARY OF THE DISCLOSURE

One or more of the above needs can be fulfilled by the process and system according to the present disclosure wherein the system comprises a gas-fed flow cell with a bipolar membrane and an acidic catholyte flow comprising one or more alkali metal cations.

According to a first aspect, the disclosure provides a process for electrolysing carbon dioxide, said process is remarkable in that it comprises the following steps:

a) providing a system comprising a gas-fed flow cell comprising a gas chamber with a gas inlet, a gas outlet, a catholyte chamber, and a gas diffusion electrode comprising a metal-based catalyst, wherein the gas diffusion electrode is placed between the gas chamber and the catholyte chamber;
b) providing a catholyte flow and an anolyte flow into said gas-fed flow cell;
c) activating said gas diffusion electrode under operating conditions;
d) providing a gas input flow comprising carbon dioxide using the gas inlet of the gas chamber to produce a direct gas stream exiting from the gas outlet of the gas chamber and a liquid catholyte output flow from the catholyte chamber comprising products, wherein said liquid catholyte output flow is degassed in a catholyte reservoir to produce an indirect gas stream exiting from a gas outlet of the catholyte chamber;

wherein the catholyte flow is an acidic catholyte flow comprising one or more alkali metal cations and in that the gas-fed flow cell comprises a bipolar membrane includes a cation-exchange layer (CEL) in contact with the catholyte and an anion-exchange layer (AEL) in contact with the anolyte; wherein the cation-exchange layer provides protons to the catholyte and the anion exchange layer provides hydroxide ions to the anolyte; in that the acidic catholyte has a pH of at most 5.5 and in that the catholyte pH is less than the anolyte pH.

With preference, the indirect gas stream exiting from the catholyte reservoir comprises carbon dioxide, and the process further comprises a step e) of recovering the indirect gas stream exiting from the catholyte reservoir and recycling said indirect gas stream into the gas input flow comprising carbon dioxide of step d).

With preference, the indirect gas stream exiting from the catholyte reservoir comprises at least 90 mol. % of $CO_2$ based on the total molar content of the indirect gas stream; preferably at least 95 mol. %; more preferably at least 98 mol. %.

Surprisingly, it has been found that it was possible to operate a system comprising a gas-fed flow cell in a way that enhances carbon dioxide regeneration from generated carbonate in the catholyte. The process of the disclosure not only provides good single-pass conversion to $CO_2R$ products (SPC) but also favours the recovery of the carbon dioxide that was converted into (bi)carbonate to recycle it back to the cell, to have it react again with the catalyst. This results in the $CO_2R$ product conversion yield being increased and avoids the loss of $CO_2$. Existing devices and processes for acidic $CO_2R$ have relied on proton exchange membranes (PEMs), such as Nafion®, to separate the anode and the cathode compartments (FIG. 3*c*). However, PEMs cannot maintain a pH gradient, the anolyte has to be acidic. The use of a bipolar membrane in the process and system of the disclosure allows, among other advantages, an asymmetric setup wherein acidic $CO_2R$ is performed using an alkaline anolyte.

According to a second aspect, the disclosure provides a system suitable to perform the process of electrolysing carbon dioxide according to the first aspect, the system comprises a gas-fed flow cell comprising a gas chamber, a catholyte chamber, and an anolyte chamber, wherein said gas chamber is separated from the catholyte chamber by a gas diffusion electrode, said gas diffusion electrode having a gas diffusion membrane being comprised within said gas chamber, wherein said catholyte chamber and said anolyte chamber comprise respectively a cathode and an anode, and wherein the system further comprises catholyte and anolyte and means to flow the catholyte and the anolyte within respectively said catholyte chamber and said anolyte chamber;

wherein the system is remarkable in that the catholyte flow is an acidic catholyte flow comprising one or more alkali metal cations, in that the gas-fed flow cell comprises a bipolar membrane includes a cation-exchange layer in contact with the catholyte and an anion-exchange layer in contact with the anolyte; wherein the cation-exchange layer provides protons to the catholyte and the anion exchange layer provides hydroxide ions to the anolyte; in that the acidic catholyte has a pH of at most 5.5 and in that the catholyte pH is less than the anolyte pH; wherein, the system further comprises a catholyte reservoir configured to receive and degas the output flow exiting the catholyte chamber, and with preference means to recover an indirect gas stream exiting the gas outlet of the catholyte reservoir and means to recycle the said indirect gas stream back into the gas chamber.

One or more of the following features advantageously further define the process and/or the system of the disclosure.

For example, the gas input flow provided in step (d) has a flow rate ranging from 0.5 to 10 mL/min; preferably from 0.6 to 5 mL/min; more preferably from 0.7 to 3.5 mL/min; even more preferably from 0.8 to 3.0 mL/Min; most preferably from 0.9 to 2.8 mL/min; and even most preferably from 1.0 to 2.5 mL/min or from 1.1 to 1.8 mL/min. It is understood that the above values are given for a cell wherein the dimensions are 7.5 cm×7.5 cm×3.2 cm. These values will be adapted by the person skilled in the art without difficulties in case the dimensions of the cell are changed.

For example, the acidic catholyte has a pH ranging from 0.5 to less than 5.5; preferably from 0.5 to 5.4 or from 0.6 to 5.4; more preferably from 0.7 to 5.2; even more preferably from 0.8 to 5.4 or from 0.8 to 5.0; most preferably from 0.9 to 4.5; even most preferably from 1.0 to 4.0 or from 1.1 to 3.5.

For example, step b) comprises providing a catholyte flow and an anolyte flow wherein the catholyte pH is less than the anolyte pH.

For example, the anolyte has a pH ranging from 7 to 15; preferably from 10 to 14, allowing non-noble metal catalysts (OER catalyst, stainless steel, Ni foam).

For example, the acidic catholyte comprises one or more acids at a concentration ranging from 0.001 to 5.0 M; preferably from 0.005 to 3.0 M or from 0.01 to 2.0 M; or from 0.05 to 1.5 M or from 0.01 to 1.0 M.

For example, the acidic catholyte comprises one or more acids at a concentration ranging from 0.01 to 1.0 M and one or more alkali metal cation donors at a concentration ranging from 0.5 to 5.0 M. With preference, the one or more alkali metal cations are weakly hydrated cations and/or the one or more alkali metal cations are one or more selected from $Cs^+$, $K^+$, $Li^+$ and $Na^+$; preferably the one or more alkali metal cations are or comprise $K^+$.

For example, the acidic catholyte comprises one or more alkali metal cation donors selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate, and sodium hydroxide; preferably selected from potassium chloride, potassium phosphate monobasic, potassium sulfate, potassium iodide, and potassium hydroxide; more preferably the one or more alkali metal cation donors are or comprise potassium chloride.

With preference, the one or more alkali metal cation donors at a concentration ranging from 0.5 to 5.0 M; preferably ranging from 1.0 to 4.5 M; and more preferably ranging from 2.0 to 4.0 M.

For example, the acidic catholyte comprises one or more acids selected from hydrochloric acid, sulfuric acid, hydrobromic acid, hydriodic acid, perchloric acid, and chloric acid; preferably sulfuric acid. With preference, the one or more acids are present at a concentration ranging from 0.01 to 1.0 M; preferably, from 0.02 to 0.5 M; more preferably ranging from 0.03 to 0.2 M.

In an embodiment, step (a) of providing a system comprising a gas-fed flow cell comprises preparing said gas-fed flow cell by spray-coating an ink comprising an ion-conducting polymer and a metal-based catalyst on a gas diffusion membrane. Therefore, the gas-fed flow cell comprises a spray-coated ink on a gas diffusion membrane, wherein the ink comprises an ion-conducting polymer and a metal-based catalyst.

In an embodiment, the metal-based catalyst is provided in the form of nanoparticles having an average diameter ranging from 5 nm to 200 nm as measured by transmission electron microscopy, preferably from 10 nm to 150 nm, more preferably from 20 nm to 100 nm.

For example, the metal of the metal-based catalyst is selected from copper, silver, and any mixture thereof; with preference, the metal-based catalyst is or comprises copper oxide nanoparticles.

For example, the metal-based catalyst is or comprises copper oxide nanoparticles and the process comprises a catalyst activation step to reduce copper oxide to metallic copper.

For example, the operating conditions at which the flow cell is operated in step c) comprise current density ranging from −100 $mA \cdot cm^2$ to −1.5 $A \cdot cm^2$; preferably from −150 $mA \cdot cm^2$ to −1.0 $mA \cdot cm^2$.

According to a third aspect, the disclosure provides the use of a system comprising a gas-fed flow cell with a bipolar membrane in a process for electrolysing carbon dioxide under acidic conditions in the presence of one or more alkali metal cations wherein the use further comprises an acidic catholyte having a pH of less than 5.5; with preference, the system is according to the second aspect and/or the process is according to the first aspect.

DETAILED DESCRIPTION

For the disclosure, the following definitions are given:

The terms "comprising", "comprises" and "comprised of" as used herein are synonymous with "including", "includes" or "containing", "contains", and are inclusive or open-ended and do not exclude additional, non-recited members, elements, or method steps. The terms "comprising", "comprises" and "comprised of" also include the term "consisting of".

The recitation of numerical ranges by endpoints includes all integer numbers and, where appropriate, fractions subsumed within that range (e.g. 1 to 5 can include 1, 2, 3, 4, 5 when referring to, for example, a number of elements, and can also include 1.5, 2, 2.75 and 3.80, when referring to, for example, measurements). The recitation of endpoints also includes the recited endpoint values themselves (e.g. from 1.0 to 5.0 includes both 1.0 and 5.0). Any numerical range recited herein is intended to include all sub-ranges subsumed therein.

Figure 1:
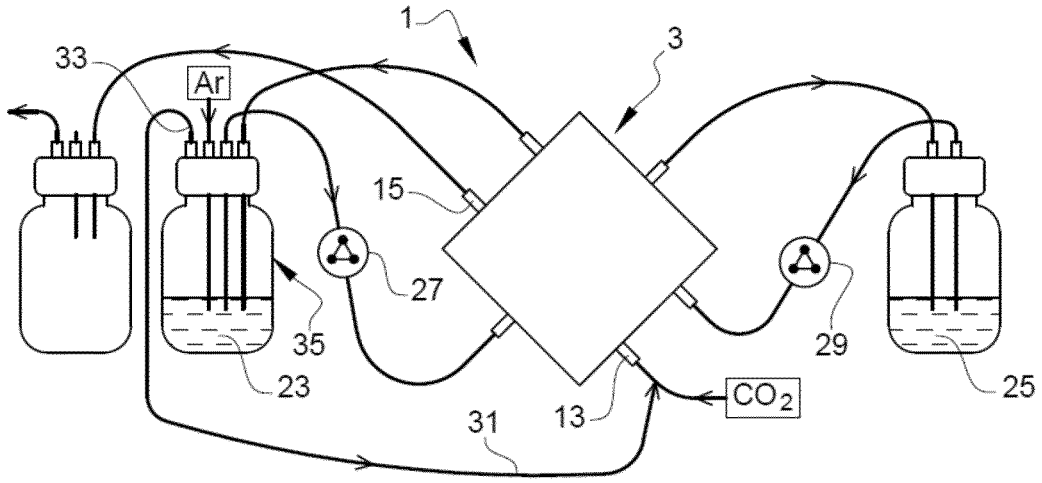
FIG. 1 illustrates a system according to the disclosure.
Figure 2:
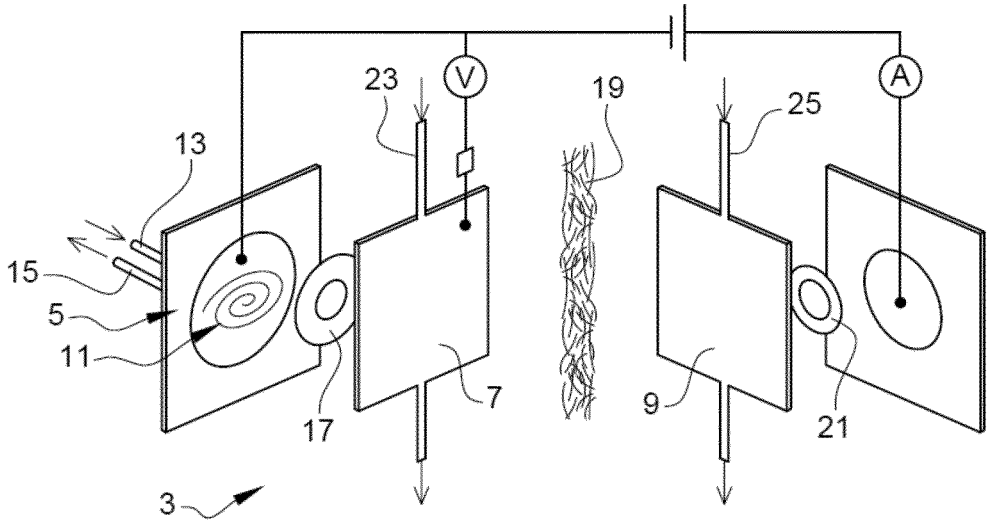
FIG. 2 illustrates a gas-fed flow cell according to the disclosure.

The disclosure provides a process for electrolysing carbon dioxide that includes $CO_2$ regeneration and recycling of said regenerated $CO_2$ back into the input flow. The disclosure also provides a system suitable for carbon dioxide electrolysis that comprises a gas-fed flow cell and means to recover $CO_2$ from the catholyte outlet and redirect it to the gas inlet. The process and the system will be described jointly by reference to FIGS. 1 and 2.

The disclosure provides a process for electrolysing carbon dioxide, said process is remarkable in that it comprises the following steps:

a) providing a system comprising a gas-fed flow cell 1 comprising a gas chamber with a gas inlet, a gas outlet, a catholyte chamber, and a gas diffusion electrode comprising a metal-based catalyst, wherein the gas diffusion electrode is placed between the gas chamber and the catholyte chamber;

b) providing a catholyte flow and an anolyte flow into said gas-fed flow cell;

c) activating said gas diffusion electrode under operating conditions;

d) providing a gas input flow comprising carbon dioxide using the gas inlet of the gas chamber to produce a direct gas stream exiting from the gas outlet of the gas chamber and a liquid catholyte output flow from the catholyte chamber comprising products, wherein said liquid catholyte output flow is degassed in a catholyte reservoir to produce an indirect gas stream exiting from the gas outlet of the catholyte reservoir;

wherein the catholyte flow is an acidic catholyte flow comprising one or more alkali metal cations and in that the gas-fed flow cell comprises a bipolar membrane includes a cation-exchange layer (CEL) in contact with the catholyte and an anion-exchange layer (AEL) in contact with the anolyte; wherein the cation-exchange layer provides protons to the catholyte and the anion exchange layer provides hydroxide ions to the anolyte.

With preference, the indirect gas stream exiting from the catholyte reservoir comprises carbon dioxide, and the process further comprises a step e) of recovering the indirect gas stream exiting from the catholyte reservoir and recycling said indirect gas stream into the gas input flow comprising carbon dioxide of step d).

Indeed, it was found that the process allows obtaining an indirect gas stream that is composed of almost pure $CO_2$, which allows the reinjection in the cell without previous separation.

For example, the indirect gas stream exiting from the catholyte reservoir comprises at least 90 mol. % of $CO_2$ based on the total molar content of the indirect gas stream; preferably at least 95 mol. %; more preferably at least 98 mol. %.

The gas-fed flow cell 3 comprises a gas chamber 5, a catholyte chamber 7, and an anolyte chamber 9. For example, the gas chamber 5 has a gas channel 11, through which a gas flow comprising $CO_2$ is circulating. Gas chamber 5 comprises a gas inlet 13 and a gas outlet 15 and is separated from the catholyte chamber 7 by a gas diffusion electrode 17. The catholyte chamber 7 and the anolyte chamber 9 (when present) are separated by a membrane 19 which is selected to be a bipolar membrane. The gas-fed flow cell comprises a cathode (not represented). The gas-fed flow cell also comprises an anode 21, for example, a Ni foam anode, which is contained in the anolyte chamber or that is in direct contact with the membrane Any oxygen evolution reaction (OER) catalyst and anode compartment design can be used. In particular when anolyte is alkaline then non noble metal catalyst can be used.

With preference, the gas-fed flow cell comprises a reference electrode. It is preferred that said reference electrode is an Ag/AgCl electrode filled with KCl at a concentration ranging from 3.0 to 3.8 M; preferably from 3.2 to 3.6 M;

even more preferably with 3.4 M of KCl. In other implementations of the invention, the reference electrode could also be a reversible hydrogen electrode (RHE).

Advantageously, the electrically conductive connection from the gas diffusion electrode 17 and the potentiostat is achieved by applying copper tape on said gas diffusion electrode 17, the copper tape being electrically connected to a metallic rod in contact with the potentiostat. For example, the metallic rod is a steel rod, preferably a stainless-steel rod.

The system is remarkable in that it comprises the catholyte being an acidic catholyte comprising one or more alkali metal cations and means to recover an indirect gas stream exiting the gas outlet of the catholyte reservoir and means to recycle the said indirect gas stream into the gas chamber.

Thus, the disclosure provides a system 1 suitable to perform the process of electrolysing carbon dioxide, the system comprising a gas-fed flow cell 3 comprising a gas chamber 5, a catholyte chamber 7, and an anolyte chamber 9, wherein said gas chamber 5 is separated from the catholyte chamber 7 by a gas diffusion electrode 17, said gas diffusion electrode 17 having a gas diffusion membrane being comprised within said gas chamber, wherein said catholyte chamber 7 and said anolyte chamber 9 comprise respectively a cathode and an anode, and wherein the system 1 further comprises catholyte 23 and anolyte 25 and means (27; 29) to flow the catholyte 23 and the anolyte 25 within respectively said catholyte chamber 7 and said anolyte chamber 9;

wherein the catholyte flow is an acidic catholyte flow comprising one or more alkali metal cations and in that the gas-fed flow cell comprises a bipolar membrane 19 comprising a cation exchange layer and an anion exchange layer wherein the cation exchange layer is comprised within the catholyte chamber and the anion exchange layer is comprised within the anolyte chamber or is contacting the anode. In other words, the bipolar membrane includes a cation-exchange layer (CEL) in contact with the catholyte and an anion-exchange layer (AEL) in contact with the anolyte; wherein the cation-exchange layer provides protons to the catholyte and the anion exchange layer provides hydroxide ions to the anolyte The system also comprises a catholyte reservoir 35 wherein the catholyte flow exiting the catholyte outlet of the gas-fed flow cell can degas and, with preference, the system 1 further comprises means 31 to recover an indirect gas stream exiting the gas outlet 33 of the catholyte reservoir and to recycle the said indirect gas stream back into the gas chamber 5.

It is preferred that the system employs bipolar membranes (BPMs), operated in reverse bias mode, which permits the use of acidic catholyte with alkaline anolyte.

Figure 5:
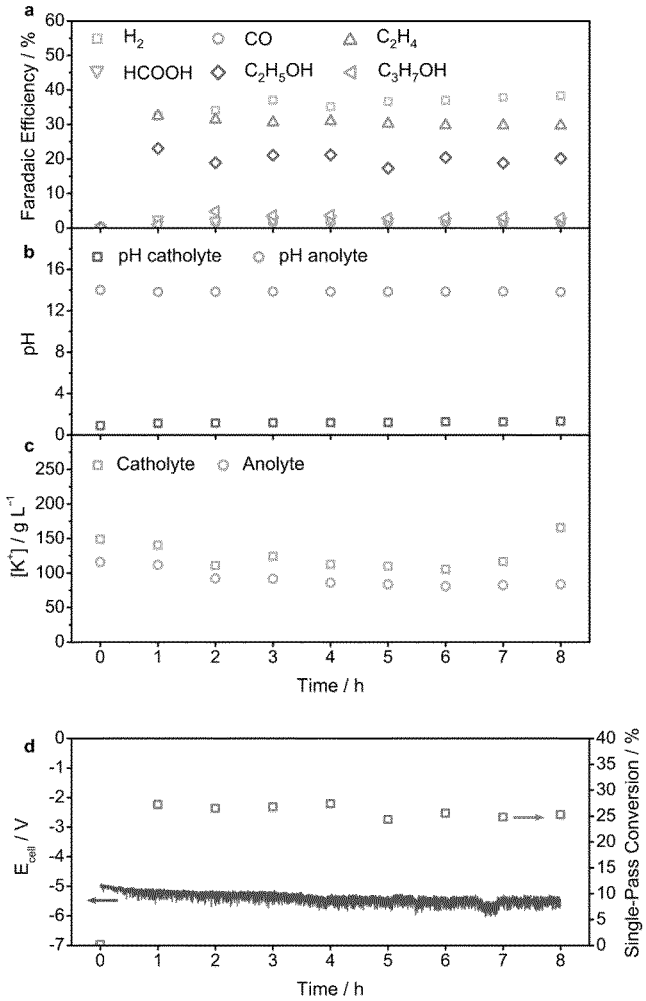
FIG. 5 Results from the stability test performed at −200 mA $cm^{-2}$ with a $CO_2$ flow rate of 1.25 mL $min^{-1}$ and a 0.05 M $H_2SO_4$+3 M KCl catholyte: a) the selectivity remains constant, with ethylene FE around 30%, b) the BPM proves to be effective in keeping an elevated pH gradient through the cell for several hours, c) $K^+$ monitoring through ICP-MS shows how the BPM is also able to stop $K^+$ crossover, maintaining a concentration around 3 M (117 g $L^{-1}$) in the catholyte and 2.5 M (98 g $L^{-1}$) in the anolyte, d) the full cell potential ($E_{full}$) and SPC are both stable with values around −5.4 V and 26%, respectively.

BPMs are composed of an anion exchange layer (AEL) coupled with a cation exchange layer (CEL), and function by carrying out water dissociation at the interlayer (IL) to transport protons toward the catholyte and hydroxide ions toward the anolyte (FIG. 5*d*). This stabilizes pHs in each compartment and maintains a pH gradient, which avoids permanent (bi) carbonate formation at the cathode while also permitting the use of Earth-abundant OER catalysts that are stable in alkaline conditions. Additionally, the transport of cations, anions, and $CO_2R$ products should be blocked by the membrane, limiting any negative effect of ion deposition at the cathode.

Although BPMs have recently shown promising results in alkaline systems and membrane electrode assemblies, they have so far not been implemented in acidic gas-fed flow cells. The disclosure discloses a BPM-based system incorporating an oxide-derived Cu catalyst, which achieves a high $C_{2+}$ selectivity (>60%) for acidic $CO_2R$. By assessing the composition of the gas outlets of the reactor, it was shown how carbonate species can be completely converted to r-$CO_2$, which is almost completely free of any products. Through analysis of selectivity, activity, and stability, it was highlighted some key advantages of bipolar membranes for high-rate $CO_2R$ in acid at high conversions.

Thus, in a preferred embodiment, the gas-fed flow cell comprises a bipolar membrane separating the catholyte chamber from the anolyte chamber. The bipolar membrane may include a cation-exchange layer (CEL) and an anion-exchange layer (AEL), wherein the cation-exchange layer is in cation communication with the catholyte to provide protons into the catholyte and the anion-exchange layer is in anion communication with the anolyte. In other words, the bipolar membrane is used to dissociate water, thereby providing hydroxide ions to the anolyte chamber and protons to the catholyte chamber. The use of a bipolar membrane allows an asymmetric set up allowing the use of acidic catholyte with alkaline anolyte. Thus, in a preferred embodiment, the catholyte pH is less than the anolyte pH and step b) of the process comprises providing a catholyte flow and an anolyte flow wherein the catholyte pH is less than the anolyte pH.

Figure 3:
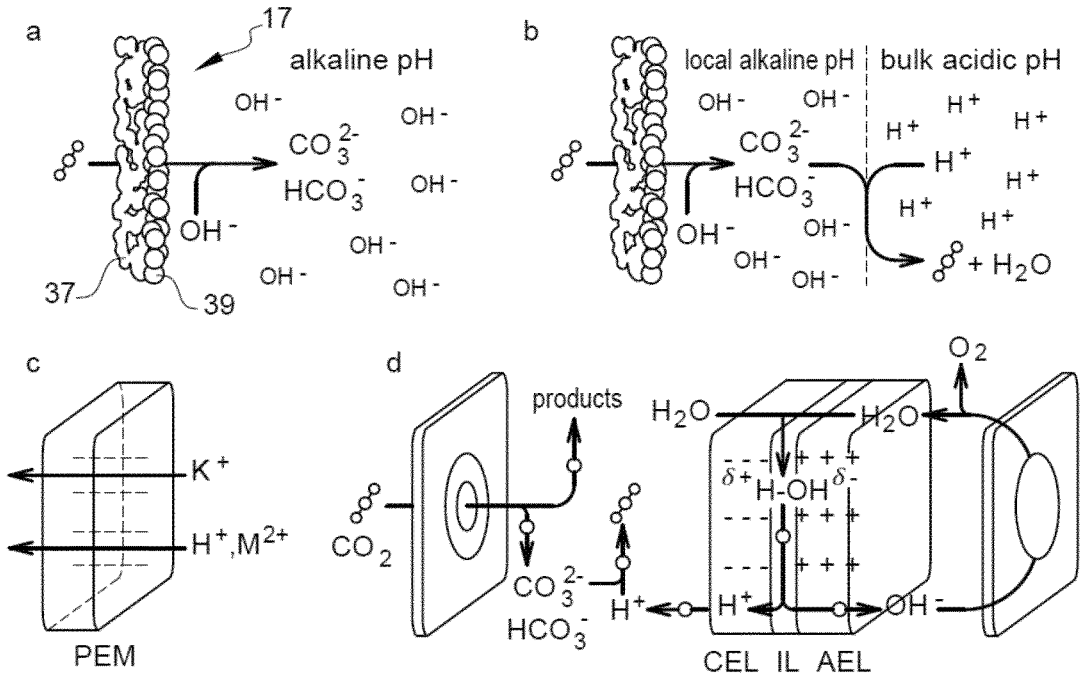
FIG. 3 Schematic representation of different catholyte configurations and different membranes: a) alkaline bulk pH, where (bi)carbonate species accumulate in solution, b) acid bulk pH, where (bi)carbonate species are formed but are reconverted to $CO_2$ by protons in the bulk solution, c) proton exchange membrane (PEM), in which positively charged species can cross, resulting in unstable electrolyte composition over time and d) full cell assembly with a bipolar membrane (BPM), where (1) $CO_2$ is reduced to products, (2) $CO_2$ is converted to (bi) carbonate, (3) $CO_2$ is regenerated, (4) $H_2O$ dissociates in the BPM interlayer, (5) protons diffuse into the catholyte allowing stable pH, (6) hydroxide ions diffuse into the anolyte allowing stable pH.

As shown in FIG. 3*a*, the gas diffusion electrode 17 of the present disclosure has a gas diffusion membrane 37 and further comprises an ink 39 deposited on the gas diffusion membrane 37; wherein the ink 39 comprises an ion-conducting polymer and a metal-based catalyst. The metal of the metal-based catalyst is preferably selected from copper, silver, and any mixture thereof. In a preferred embodiment, the metal-based catalyst is or comprises copper oxide nanoparticles.

Thus, in a preferred embodiment, step (a) of providing a system comprising a gas-fed flow cell comprises preparing said gas-fed flow cell by spray-coating an ink 39 comprising an ion-conducting polymer and a metal-based catalyst on a gas diffusion membrane 37.

For example, the metal-based catalyst is or comprises copper oxide nanoparticles and the process comprises a catalyst activation step to reduce copper oxide to metallic copper.

The gas diffusion membrane 37 allows for the diffusion of carbon dioxide as the main reactant of the electrolysis reaction into the electrochemical cell and is preferably hydrophobic porous support. In gas-fed flow cell 3, the gas diffusion membrane 37 is comprised within the gas chamber 5 of said gas-fed flow cell 3. With preference, said support shows a pore size ranging from 400 nm to 500 nm as determined by scanning electron microscopy, preferably from 420 nm to 580 nm or from 440 nm to 560 nm. The gas diffusion membrane is preferably selected from an ion-conducting polymer-based membrane, an ion-conducting inorganic material, a combination polymer/inorganic based membrane, and the like.

It is preferred that the gas diffusion membrane is a hydrophobic, porous, and chemically inert support. For example, the gas diffusion membrane 37 is or comprises polytetrafluoroethylene (PTFE). Examples of suitable membranes are commercially available from Fisher Scientific SAS under the commercial denomination Sartorius.

With preference, the gas diffusion membrane 17 has a circular shape and/or has a surface area of at least 1 $cm^2$ or at least 2 $cm^2$. For example, the gas diffusion membrane 17 has a thickness ranging from 2 μm to 50 μm measured by scanning electron microscopy, preferably from 5 μm to 40 μm, more preferably from 8 μm to 30 μm.

An ink 39 is deposited on the gas diffusion membrane 37 and comprises an ion-conducting polymer. With preference, the ion-conducting polymer is or comprises an ionomer. For example, the ion-conducting polymer is or comprises an ionomer with a tetrafluoroethylene backbone group (—CF2-CF2-). Such ionomers are capable of creating strongly hydrophobic nanoporous networks. For example, said ion-conducting polymer is or comprises a perfluorinated sulfonic acid, such as Nafion® (tetrafluoroethylene-perfluoro-3,6-dioxa-4-methyl-7-octenesulfonic acid copolymer); and/or the ion-conducting polymer is or comprises tetrafluoroethylene-perfluoro (3-hydrophobioxa-4-pentenesulfonic acid) copolymer, such as Aquivion®.

The ink can form a layer on the gas diffusion membrane, said layer having a thickness ranging from 2 nm and 100 μm measured by transmission electron microscopy, preferably from 4 μm and 10 μm, more preferably from 5 μm and 8 μm. In a preferred embodiment, the ink is deposited on the gas diffusion membrane by spray-coating.

For example, ink 19 has a ratio of the copper oxide nanoparticles over the ion-conducting polymer. With preference, the ink has a ratio of the copper oxide nanoparticles over the ion-conducting polymer ranging from 0.1 to 10 μL of ion-conducting polymer for 1 mg of catalyst (1:1).

For example, the gas diffusion electrode 17 has a mass loading of the ink 39 onto said gas diffusion membrane 37 ranging from 0.50 mg/cm$^2$ to 4.00 mg/cm$^2$, preferably from 1.50 mg/cm$^2$ to 3.00 mg/cm$^2$; and more preferably from 2.00 mg/cm$^2$ to 2.50 mg/cm$^2$. The mass loading can be determined by weighing before and after deposition and drying.

In a preferred embodiment, the metal-based catalyst is provided in the form of nanoparticles having an average diameter ranging from 5 nm to 200 nm as measured by transmission electron microscopy, preferably from 10 nm to 150 nm, more preferably from 20 nm to 100 nm.

For example, the copper oxide nanoparticles have an average diameter ranging from 5 nm to 200 nm as measured by transmission electron microscopy, preferably from 10 nm to 150 nm, more preferably from 20 nm to 100 nm.

In a preferred embodiment, the gas input flow provided in step (d) has a flow rate of at most 10 mL/min; preferably, at most 5 mL/min; more preferably at most 3.5 mL/min; even more preferably at most 3.0 mL/Min; most preferably at most 2.8 mL/min; and even most preferably at most 2.5 mL/min or at most 1.8 mL/min. Indeed, as demonstrated in the example section, it was found that operating at a low flow rate of $CO_2$ enhances the single-pass conversion to multicarbon $CO_2R$ products (SPC).

For example, the gas input flow provided in step (d) has a flow rate of at least 0.5 mL/min; preferably of at least 0.6 mL/min; more preferably of at least 0.7 mL/min; even more preferably of at least 0.8 mL/Min; most preferably of at least 0.9 mL/min; and even most preferably of at least 1.0 mL/min or at least 1.1 mL/min. Indeed, as demonstrated in the example section, it was found that operating at a too low flow rate enhances $H_2$ production. It is understood that the above values are given for a cell wherein the dimensions are 7.5 cm×7.5 cm×3.2 cm. These values will be adapted by the person skilled in the art without difficulties in case the dimensions of the cell are changed.

For example, the gas input flow provided in step (d) has a flow rate ranging from 0.5 to 10 mL/min; preferably from 0.6 to 5 mL/min; more preferably from 0.7 to 3.5 mL/min; even more preferably from 0.8 to 3.0 mL/Min; most preferably from 0.9 to 2.8 mL/min; and even most preferably from 1.0 to 2.5 mL/min or from 1.1 to 1.8 mL/min.

Thus, it is preferred that the system further comprises a mass flow controller that is operatively connected to the gas chamber inlet to adjust an inlet gas flow rate.

For example, the gas input flow provided in step (d) comprises at least 3 mol % of carbon dioxide based on the total molar content of the input flow; preferably at least 20 mol % of carbon dioxide, more preferably at least 50 mol % of carbon dioxide In a preferred embodiment, the gas input flow provided in step (d) comprises at least 85 mol % of carbon dioxide based on the total molar content of the input flow; preferably at least 90 mol % of carbon dioxide, more preferably at least 95 mol % of carbon dioxide; and even more preferably at least 98 mol %. For example, the gas input flow further comprises $N_2$.

In a preferred embodiment, the acidic catholyte has a pH of less than 5.5 or of at most 5.4; preferably of at most 5.2; more preferably, of at most 5.0; even more preferably of at most 4.8 or of at most 4.6; most preferably of at most 4.5 or of at most 4.2; even most preferably of at most 4.0 or of at most 3.5.

For example, the acidic catholyte has a pH of at least 0.5; preferably of at least 0.6; more preferably, of at least 0.7; even more preferably of at least 0.8 or at least 0.9; most preferably of at least 1.0 or above 1.0; even most preferably of at least 1.1.

For example, the acidic catholyte has a pH ranging from 0.5 to less than 5.5 or from 0.5 to 5.4; preferably from 0.6 to 5.2; more preferably from 0.7 to 5.0; even more preferably from 0.8 to 5.4 or from 0.8 to 5.0; most preferably from 0.9 to 4.5; even most preferably from 1.0 to 4.0 or from 1.1 to 3.5.

For example, the acidic catholyte comprises one or more acids at a concentration ranging from 0.001 to 5.0 M; preferably from 0.005 to 3.0 M or from 0.01 to 2.0 M; or from 0.05 to 1.5 M or from 0.01 to 1.0 M.

In an embodiment, the acidic catholyte comprises one or more acids at a concentration ranging from 0.001 to 5.0 M and one or more alkali metal cation donors at a concentration ranging from 0.5 to 5.0 M.

For example, the cations are weakly hydrated cations, and/or the alkali metal cations are one or more selected from Cs+, K+, Li+, and Na+; preferably the one or more alkali metal cations are or comprise K+.

For example, the acidic catholyte comprises one or more alkali metal cation donors selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate, and sodium hydroxide; preferably selected from potassium chloride, potassium phosphate monobasic, potassium sulfate, potassium iodide, and potassium hydroxide; more preferably the one or more alkali metal cation donors are or comprise potassium chloride.

With preference, the one or more alkali metal cation donors at a concentration ranging from 0.5 to 5.0 M; preferably ranging from 1.0 to 4.5 M; and more preferably ranging from 2.0 to 4.0 M.

In an embodiment, the acidic catholyte comprises one or more acids selected from hydrochloric acid, sulfuric acid, hydrobromic acid, hydriodic acid, perchloric acid, and chloric acid; preferably sulfuric acid.

For example, the one or more acids are present at a concentration ranging from 0.01 to 1.0 M; preferably, from 0.02 to 0.5 M; more preferably ranging from 0.03 to 0.2 M.

For example, the anolyte is an aqueous solution of one or more inorganic bases having a concentration ranging from 1 M to 10 M; preferably from 3 to 7 M or from 5 M to 10 M. For example, the aqueous solution of one or more inorganic bases has a concentration that is at least 5 M. With preference, the anolyte has a pH ranging from 7 to 15; preferably from 10 to 14.

With preference, the one or more inorganic bases are alkali selected from NaOH, KOH, $Ca(OH)_2$, LiOH, $Mg(OH)_2$, RbOH, CsOH, and any mixture thereof. With preference, the one or more inorganic bases are or comprise KOH and/or NaOH.

The system preferably comprises one or more peristaltic pumps operatively connected to a first tube in fluid communication with the anolyte chamber to circulate the anolyte therein, and to a second tube in fluid communication with the catholyte chamber to circulate the catholyte therein. It is preferred that the catholyte and anolyte are circulated at a constant flow rate. For example, the catholyte flow rate is around 25 mL/min, while the anolyte flow rate is around 5.5 mL/min In an embodiment the operating conditions at which the flow cell is operated in step c) comprise current density ranging from $-100\ mA \cdot cm^2$ to $-1.5\ A \cdot cm^2$; preferably ranging from $-120\ mA \cdot cm^2$ to $-1.2\ A \cdot cm^2$; more preferably from $-150\ mA \cdot cm^2$ to $-1.0\ A \cdot cm^2$.

In an embodiment the operating conditions at which the flow cell is operated in step c) comprises a voltage ranging from −1.7 V to −7 V; preferably ranging from −3.5 V to −6 V and more preferably from −4.5 V to −5.5 V.

Thus, the system further comprises a power source providing electric current at an applied current density.

Test Methods

Mass loading of the ink onto the gas diffusion membrane: The membrane was weighed using an analytical balance before deposition and after drying overnight in a vacuum desiccator.

Transmission Electron Microscopy: TEM analysis was conducted using a Jeol 2100F microscope equipped with Schottky Field Emission electron gun and an ultra-high resolution polar piece.

Scanning Electron Microscopy: SEM images were obtained using a SU-70 Hitachi FEG-SEM.

X-Ray Diffraction: XRD data were obtained from a D8 ADVANCE diffractometer (Bruker) using a Cu Kα X-ray source (1.5406 Å). Peaks were attributed using the PDF-2/release 2013 RDB database.

Nuclear Magnetic Resonance: Liquid products were analysed using $^1H$ NMR with a presaturation water suppression method on a Bruker Advance III 300 MHz spectrometer at 300 K. $D_2O$ was used as the lock solvent and an aqueous solution of terephthalic acid was used as an internal standard for quantification.

Inductively Coupled Plasma Mass Spectrometry: The quantification of $K^+$ was performed with a Nexion 2000B inductively coupled plasma atomic mass spectrometer (Perkin-Elmer) using the Syngistix™ software.

Gas products were detected on-line using an SRI instruments 8610 GC with Ar as the carrier gas. The GC was fitted with a thermal conductivity detector for H2 quantification, where the gas was separated using a HaySepD precolumn with a 3 m molecular sieve column. Carbon products were separated using a 5 m HaySepD column (CO, C2H4) and detected using a flame-ionization detector fitted with a methanizer. Calibration was performed using a custom standard gas mixture in CO2.

The FE for gas products was calculated using equation 1:

$$FE(\%) = \frac{n_{product} \times n_{electrons} \times F}{(Q_{t=0} - Q_{t=x})} \quad (1)$$

Where $n_{product}$ is the amount of product obtained (mol), $n_{electrons}$ is the number of electrons used to make the product, F is the Faraday constant (C mol−1), $Q_{t=0}$ is the charge at the time of the injection, and $Q_{t=x}$ is the charge at time x seconds before the injection, representing the time taken to fill the sample loop, with x depending on the combined flow rate of Ar and $CO_2$ as well as the loop size.

Liquid Product Analysis

Liquid products were analysed using 1H NMR with a presaturation water suppression method on a Bruker Advance III 300 MHz spectrometer at 300 K. D2O was used as the lock solvent and an aqueous solution of terephthalic acid was used as an internal standard for quantification. The product crossover through the bipolar membrane was accounted for by liquid sampling from the anode compartment Electrolyte Analysis The quantification of $K^+$ was performed with a Nexion 2000B inductively coupled plasma atomic mass spectrometer (Perkin-Elmer) using the Syngistix™ software.

Single-Pass Conversion Calculations

The single-pass conversion was calculated for each product using equation 2:

$$SPC\ (\%) = \left[\left(\frac{j_{product} \times 60\ s}{n_{electrons} \times F}\right) \div \left(\frac{\text{flow rate}}{24.05\ L}\right)\right] \times \text{carbon atoms} \times 100 \quad (2)$$

Where $j_{product}$ is the partial current density for a particular product ($mA\ cm^{-2}$), $n_{electrons}$ is the number of electrons needed for the reduction, F is the Faraday constant ($C\ mol^{-1}$), the flow rate is the one chosen for $CO_2$ ($L\ min^{-1}$), and 24.05 L equals to the molar volume of a gas at NTP. The total SPC % is obtained by adding the individual SPC % together.

Productivity Calculations

The productivity (P, in mg of reduced $CO_2$ $min^{-1}$ $cm^{-2}$) was calculated for each $CO_2$ inlet flow rate value according to equation 3:

$$P = mm_{CO2} \times \frac{CO_{2red}}{t_{GC}} \times 1000 \quad (3)$$

Where $mm_{CO2}$ is the molar mass of $CO_2$ ($g\ mol^{-1}$), $CO_{2red}$ is the amount of reduced $CO_2$ (mol) and $t_{GC}$ is the time needed to fill the GC loop (min) with a specific $CO_2$ inlet flow rate. The GC loop volume (0.5 mL) is the unit used to quantify the amounts of $CO_2$ and products.

EXAMPLES

Example 1: Synthesis of the Catalyst and Preparation of the Gas Diffusion Electrodes A CuO catalyst was synthesized using a simple solvothermal procedure as described in Z. Shan Hong, Y. Cao, J. fa Deng, Mater. Lett. 2002, 52, 34-38.

In brief, a solution of Cu(acetate)$_2$ in ethanol was heated to 200° C. in an autoclave for 20 h to obtain nanoparticles approximately 50 nm in size.

Figure 7:
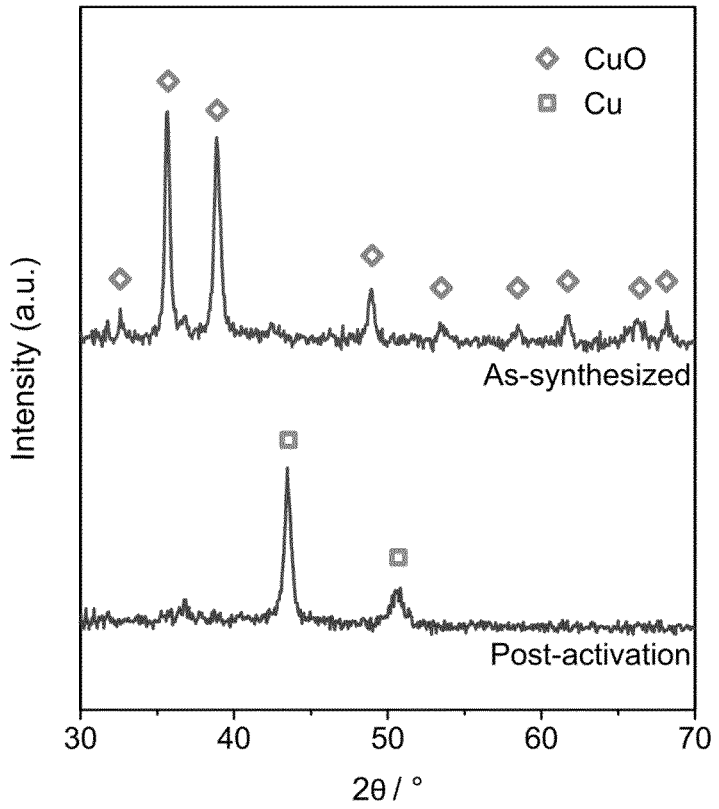
FIG. 7 X-ray diffraction (XRD) diffractograms for the as-synthesized CuO nanoparticles (top) and the reduced Cu catalyst after activation (bottom).

Gas diffusion electrodes (GDEs) were formed by spray-coating an ink being a methanolic solution containing CuO nanoparticles and Nafion® (tetrafluoroethylene-perfluoro-3,6-dioxa-4-methyl-7-octenesulfonic acid copolymer) onto a polytetrafluoroethylene (PTFE) membrane to reach a loading of 2 mg cm$^{-2}$, corresponding to an approximate thickness of 6 μm An activation step was required to obtain metallic Cu from the initial oxide, which involved running consecutive linear sweep voltammograms (LSVs) from 0.1 V to −1 V vs. RHE until the response was constantly followed by chronopotentiometry (CP) at −200 mA for 1 h using a 3 M KCl solution as the catholyte (XRD in FIG. 7). These activated Cu-GDEs were used for all experiments.

Example 2—Electrochemical Experiments

Figure 8:
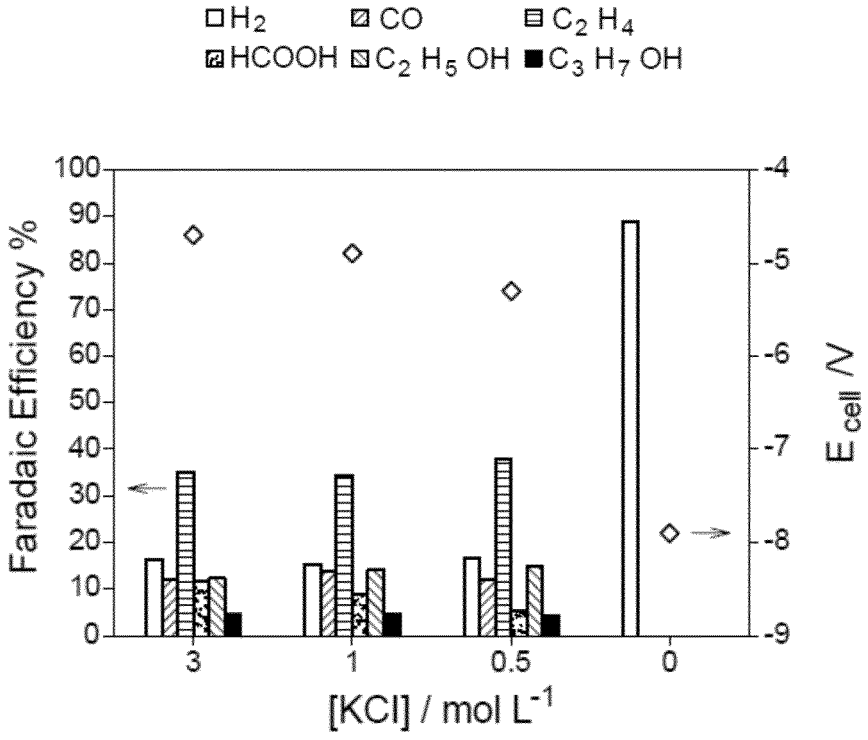
FIG. 8 Effects of varying concentrations of KCl in a 0.05 M $H_2SO_4$ electrolyte with a 10 mL $min^{-1}$ $CO_2$ inlet flow rate. When no KCl is present, $CO_2$ is not reduced and instead HER is predominant. 0.5 M of KCl is already enough to suppress $H_2O$ reduction, but since 3 M yields the same product distribution with a less negative $E_{cell}$, we decided to choose this value for our catholyte.

The anolyte (2.5 M KOH, pH 14) was kept constant throughout all experiments and only the catholyte composition was varied. A catholyte comprising $H_2SO_4$ (0.05 M, pH 1) was selected and the effects arising from the addition of varying amounts of KCl were explored. As expected, the addition of KCl improved selectivity by limiting $H_2$ evolution (FIG. 8). The high conductivity of the electrolyte salt also reduced the solution resistance, thereby lowering the full cell potential. With 3 M KCl, a high $C_{2+}$ product selectivity (52%) and a low cell potential (−4.7 V, −200 mA cm$^{-2}$) were achieved.

A parameter employed to showcase and evaluate the cell performance is the single-pass $CO_2$ conversion to $CO_2R$ products (SPC), which describes the yield of $CO_2R$ products, see below equation 3.

$$SPC\ (\%) = \left\{\left[\left(\frac{j_{product} \times 60\ \text{s}}{n_{electrons} \times F}\right) + \left(\frac{\text{flow rate}}{\text{molar volume}}\right)\right] \times \text{carbon atoms} \times 100\right\} \quad \text{(Equation 3)}$$

In equation 3, $j_{product}$ is the partial current density for a specific product (mA cm$^{-2}$), $n_{electrons}$ is the number of electrons needed for the reduction, F is the Faraday constant, the flow rate is the one chosen for the inlet $CO_2$ (mL min$^{-1}$), and 24.05 L equals to the molar volume of a gas at normal temperature and pressure. Several factors can alter the SPC including the reaction rate, the flow rate of $CO_2$, and the type and amount of products generated. This is because the product influences the amount of hydroxide ions formed, which in turn will determine how much $CO_2$ is converted to transient (bi)carbonate species (see Eq. 1-2). In an ideal reactor with complete selectivity for CO, two OH− are formed for every molecule of product. Consequently, only 50% of the input $CO_2$ (i.e., $CO_2$ in) can be converted to reduction products. Similarly, in the case of a catalyst selective only towards ethylene twelve $OH^-$ are generated per molecule of ethylene formed, resulting in a maximum ethylene yield of only 25% (see eq. 4 and 5). This results in the SPC being heavily dependent on the fate of the r-$CO_2$ (equation 3).

$$CO_2 + H_2O + 2e^- \rightleftarrows CO + 2OH^- \quad \text{(Equation 4)}$$

$$2\ CO_2 + 8\ H_2O + 12e^- \rightleftarrows C_2H_4 + 12\ OH^- \quad \text{(Equation 5)}$$

Figure 4:
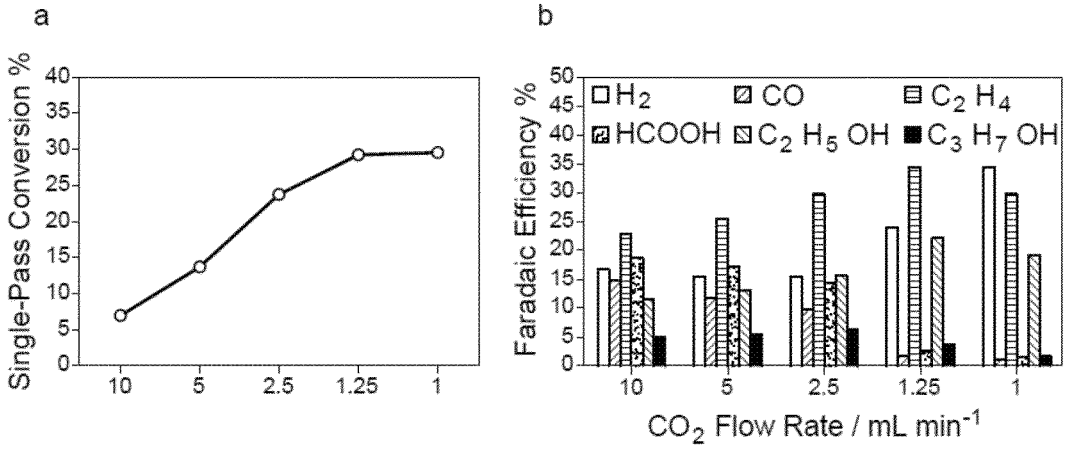
FIG. 4 Results of the flow rate test concerning a) single-pass conversion and b) selectivity of the system. The data were obtained after performing each electrolysis for 30 min at −200 mA $cm^{-2}$ with a 0.05 M $H_2SO_4$+3 M KCl catholyte. a) Reducing the $CO_2$ flow rate enhances the SPC, which reaches a maximum of (29±3) % at 1.25 mL $min^{-1}$. b) Decreasing the flow rate from 10 to 1.25 mL $min^{-1}$ results in a selectivity loss for $C_1$ products in favour of $C_{2+}$ products. The optimal flow rate is 1.25 mL $min^{-1}$, which provides high selectivity for $C_{2+}$ species, 60%, and a good SPC value of (29±3)%. These two parameters reach a plateau starting from 1 mL $min^{-1}$ due to excessive $H_2$ production, a result of scarce $CO_2$ availability in these conditions. The error bars represent the standard deviation of three measurements.

These effects were explored by altering the $CO_2$ inlet flow rate at a fixed current density of −200 mA cm$^{-2}$. As expected, decreasing the flow rate increased the SPC to reach a high SPC value of (29±3) % at 1.25 mL min$^{-1}$ (FIG. 4*a*). Lowering the flow rate to 1 mL min$^{-1}$ does not lead to a better SPC, which plateaus around 29%; instead, the Faradaic efficiencies (FEs) of $CO_2R$ products decrease while hydrogen production becomes dominant. This loss in $CO_2R$ selectivity at 1 mL min$^{-1}$ represents the region in which all $CO_2$ is either converted to $CO_2R$ products or (bi)carbonate. Hence, due to the scarcity of $CO_2$, the surplus current density is mainly used for water reduction to $H_2$, which leads to poor selectivity.

Figure 9:
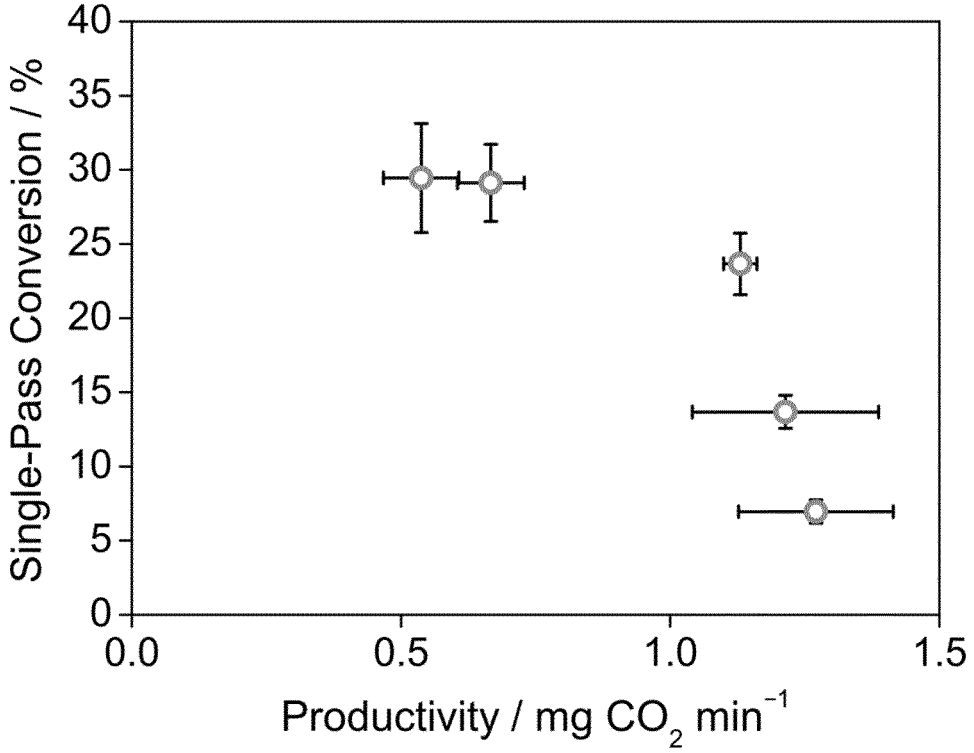
FIG. 9 Single-pass conversion as a function of the productivity of the reactor expressed in mg of $CO_2$ converted to reduction products per minute. The 30 min electrolysis was carried out in 0.05 M $H_2SO_4$+3 M KCl at −200 mA $cm^{-2}$ with increasing $CO_2$ inlet flow rate (from 1 to 10 mL $min^{-1}$, from left to right). The correlation shows a clear trade-off between conversion and productivity.
Figure 10:
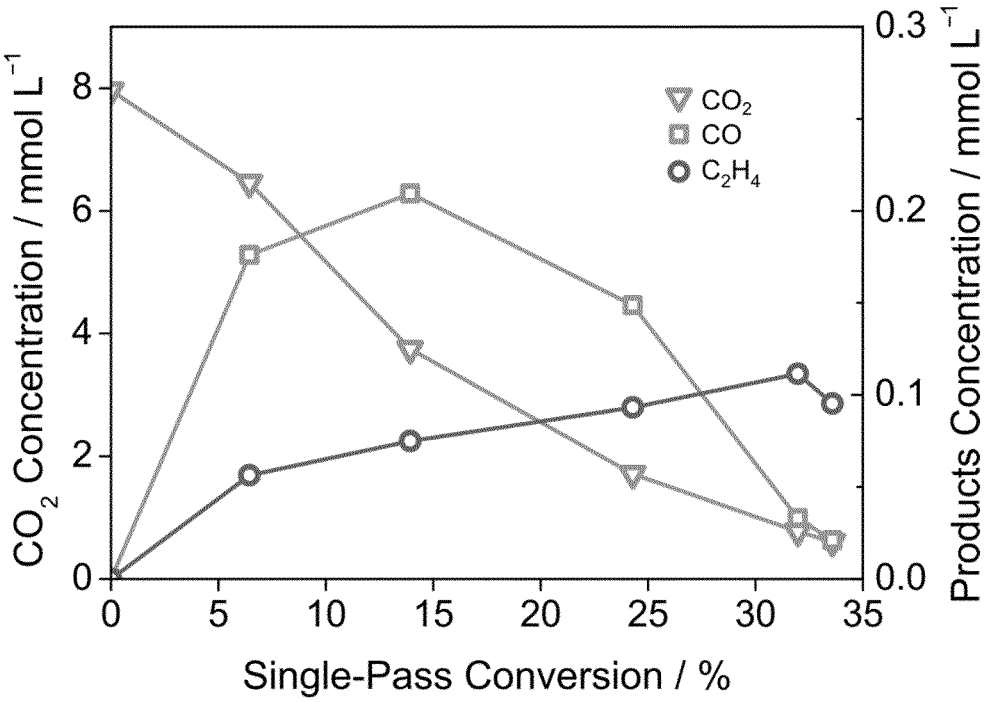
FIG. 10 Concentration of reactant ($CO_2$), intermediate (CO) and product ($C_2H_4$) as a function of single-pass conversion for an electrolysis at −200 mA $cm^{-2}$ with a $CO_2$ inlet flow rate of 1.25 mL $min^{-1}$. CO decreases while $C_2H_4$ increases in parallel with the SPC %, which in line with a series reaction that has CO as the intermediate. These concentrations comprise both the direct and indirect streams, and a purging argon flow of 35 mL $min^{-1}$ is taken in to account.

Interestingly, it was observed an increase in $C_{2+}$ Faraday efficiency with a decreasing flow rate of $CO_2$ at the expense of $C_1$ products (FIG. 4*b*). High FEs for ethylene, (34±4) %, and ethanol, (22±3) %, were obtained at 1.25 mL min$^{-1}$. To help rationalize this, the $CO_2$, $C_1$, and $C_{2+}$ concentrations were plotted as a function of conversion (see FIGS. 9 and 10), which shows that the concentrations for $C_1$ products are decreasing while those for C2+ products increase in parallel to conversion. This concentration profile is typical for a series reaction and in line with the conversion of $CO_2$ to $C_{2+}$ products via CO as an intermediate (see T. K. Todorova, M. W. Schreiber, M. Fontecave, *ACS Catal.* 2020, 10, 1754-1768.).

At low conversions $CO_2$ concentrations and hence $CO_2$ coverage of active sites are high, resulting in the formation of mainly primary C1 products. With increasing conversions, however, $CO_2$ concentrations are reduced while CO concentrations are increased alongside their respective coverage on active sites, resulting in an increasing Faraday efficiency for secondary $C_{2+}$ products. This increase in Faraday efficiency alongside conversion is likely to be amplified by $C_{2+}$ formation from CO which is probably a second-order reaction.

At high conversions, most of the $CO_2$ seems to be directly converted to $C_{2+}$ products and not to the $C_1$ product formate, inert to further electroreduction. This hints at the reaction rate of $C_{2+}$ formation being considerably higher compared to the reaction rate of formate formation at high conversions.

The ability of the electrolyser to operate at high conversion over extended periods was assessed. Over 8 h, the FEs for $CO_2R$ products were stable and, through analysis of liquid samples from the anolyte using $^1$H NMR, it was confirmed that there was no product crossover between the cell compartments. Additionally, it was shown that a stable catholyte pH could be maintained for the duration of the experiment even with an alkaline anolyte. Inductively coupled plasma-mass spectroscopy (ICP-MS) was used to detect any crossover of $K^+$ and it was observed that there is no significant shift in $K^+$ concentration on either side of the cell. The system could keep a constant full cell potential ($E_{cell}$) of −5.4 V with an average SPC of 26% towards $CO_2R$ products.

The stability of the electrolyte in terms of pH and $K^+$ concentration highlights two clear benefits of the BPM. However, this kind of membranes introduces a voltage penalty due to water dissociation at the IL, which thermodynamic value is 0.83 V in our case and changes depending on the pH gradient between the cell compartments. This is why the reactor reaches the high $E_{cell}$ value of −5.4 V. Despite this disadvantage, recent progress in catalyst-loaded BPMs opens ways to keep the many benefits of bipolar membranes while avoiding the negative voltage contribution.

With the system employed, if the r-$CO_2$ were to completely re-react on the copper surface to form products, it would be possible to achieve 100% SPC with the appropriate flow rate at a given current. However, this was not the case as the scarce availability of $CO_2$ at flow rates lower than 1.25 mL $min^{-1}$ leads to a trade-off in FE with more $H_2$ generation. Additionally, the r-$CO_2$ in the electrolyte is not expected to re-react on the copper NPs, since the high $OH^-$ concentration at the catalyst surface would convert $CO_2$ to (bi)carbonate once again, therefore the $CO_2$ is more likely to degas through the catholyte solution. Considering this observation and the delicate dependency of the SPC on the product distribution, its value does not entirely reflect the $CO_2$ conversion efficiency of the system.

Thus, instead of striving to achieve high SPC values, having an elegant way of recovering and potentially recycling the $CO_2$ lost as carbonate seems more important. As a consequence, the composition of the different gas outlets of the reactor is highly important when identifying the best recycling method for the r-$CO_2$.

There are two gas outlets in the system. The first one is positioned at the back of the GDE and is identified as the direct outlet, which collects the unreacted $CO_2$ and the gas products. The other one is located in the catholyte reservoir and is termed as the indirect outlet, which collects the (r-)$CO_2$ and gas products that come from the solution. The streams coming out from both outlets under $CO_2R$ conditions were analysed as well as under non-catalytic conditions to better understand the $CO_2$ distribution.

Figure 6:
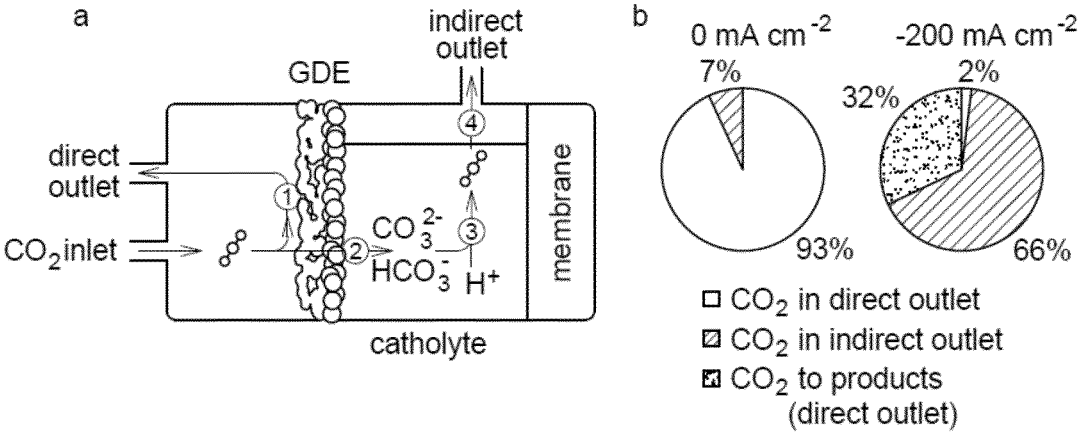
FIG. 6 Schematic representation of the two outlets of the reactor (a) and how $CO_2$ is distributed among them (b). The results were collected after 30 min electrolysis with a $CO_2$ flow rate of 1.25 mL $min^{-1}$ and a 0.05 M $H_2SO_4$+3 M KCl catholyte. a) $CO_2$ and gaseous products can be collected either at the direct outlet or from the indirect outlet. The $CO_2$ pathway to products is not shown for simplicity. (1) $CO_2$ that bypasses the cell without crossing the GDE, (2) $CO_2$ conversion to (bi)carbonate, (3) $CO_2$ regeneration, and (4) r-$CO_2$ that degasses from the solution and exits through the catholyte outlet. b) When no current is applied, most of the inlet $CO_2$ can be found at the gas outlet (93%), while during the electrolysis the majority is collected from the catholyte stream (66%). The main difference between the two situations is that in the first case the $CO_2$ never reacts, and in the latter what can be collected is essentially regenerated $CO_2$.

Firstly, we checked the amount of $CO_2$ passing through each exit point under idle conditions (0 mA $cm^{-2}$) and under operating conditions (−200 mA $cm^{-2}$) while keeping the inlet $CO_2$ flow rate constant at 1.25 mL $min^{-1}$ (FIG. 6*b*). In both cases, the total amount of $CO_2$ and $CO_2R$ products was the same, therefore providing a closed carbon mass balance. With no current, the majority of the inlet $CO_2$ (93%) was retrieved at the direct outlet. In contrast, under operating conditions, only a small fraction of inlet $CO_2$ (2%) was obtained at the direct outlet, while the rest, which is all r-$CO_2$, was found in the gas from the catholyte stream (66%).

This distribution shows that during electrolysis almost all of the inlet $CO_2$ crosses the GDE and is converted to either reduction products, which account for 32% of the inlet $CO_2$, in line with a SPC value of 29%, or (bi)carbonate. Then, the (bi)carbonate species are completely neutralized to regenerate $CO_2$, which exits the system preferentially through the indirect outlet. The composition of both streams showed that all the carbon gas products are obtained at the direct outlet, and only small quantities of hydrogen are seen in the indirect outlet stream alongside the r-$CO_2$. Consequently, the indirect stream can potentially be collected and readily recycled through the electrolyzer $CO_2$ inlet, where the $CO_2$ would be available to react again while $H_2$ and $CO_2R$ products leave the electrolyzer via the direct outlet as a concentrated gas flow, elegantly avoiding downstream $CO_2$/products separation through processes such as amine-based capture, which typically dominates the energy consumption of the product purification. As devices move towards commercial operation at high conversions, cell modifications to improve gas management and $CO_2$ recovery will become highly important. Here we show that in this cell design and setup, independent of the used membrane, simple recovery would benefit overall device performance.

In conclusion, the $CO_2R$ system of the disclosure shows high $C_{2+}$ selectivity and good SPC that allows an easy recycling of $CO_2$. This result was obtained thanks to a combination of acid catholyte, which promotes the regeneration of $CO_2$ from carbonate, and low $CO_2$ inlet flow rate, which enhances the SPC and multicarbon products selectivity.

The optimized system, running at −200 mA $cm^{-2}$ with a $CO_2$ flow rate of 1.25 mL $min^{-1}$, can achieve satisfying results, with an SPC value of (29±3) % and a $C_{2+}$ product FE of 60%. In addition, it was able to recover an almost pure stream of r-$CO_2$ from the indirect outlet of the reactor, which opens the possibility of direct recycling avoiding the energy-intensive $CO_2$ separation from the products. At the same time, the direct outlet gives a flow of concentrated products with very little $CO_2$ content. The integration of a BPM in the reactor allows the use of inexpensive OER catalysts, other than opening the possibility for oxidation reactions requiring a lower overpotential and yielding more valuable products than $O_2$.

Results are reported in the below tables

TABLE S1

Faradaic efficiencies and single-pass conversion values corresponding to the different inlet flow rates of $CO_2$ tested at −200 mA $cm^{-2}$.

| Q/mL | | Faradaic Efficiency/% | | | | | | |
|---|---|---|---|---|---|---|---|---|
| $min^{-1}$ | $E_{cell}$/V | $H_2$ | CO | $C_2H_4$ | HCOOH | $C_2H_5OH$ | $C_3H_7OH$ | SPC % |
| 10 | −5.3 ± 0.3 | 16.7 ± 2.5 | 14.7 ± 2.7 | 22.8 ± 6.5 | 18.6 ± 5.8 | 11.5 ± 3.1 | 5 ± 0.3 | 7 ± 0.8 |
| 5 | −5.4 ± 0.1 | 15.3 ± 0.7 | 11.8 ± 3.6 | 25.4 ± 5.4 | 17 ± 6.1 | 13 ± 4.1 | 5.5 ± 0.9 | 13.7 ± 1.1 |
| 2.5 | −5.5 ± 0.2 | 15.4 ± 0.6 | 9.9 ± 1.8 | 29.6 ± 3.9 | 14.3 ± 3.3 | 15.7 ± 2.1 | 6.3 ± 0.2 | 23.7 ± 2.1 |
| 1.25 | −5.5 ± 0.3 | 23.9 ± 2.9 | 1.6 ± 0.6 | 34.3 ± 4 | 2.6 ± 0.6 | 22 ± 2.8 | 3.7 ± 1.1 | 29.1 ± 2.6 |
| 1 | −5.6 ± 0.3 | 34.2 ± 3.5 | 1.1 ± 0.3 | 29.6 ± 3 | 1.6 ± 0.5 | 19.1 ± 2.8 | 1.8 ± 1 | 29.4 ± 3.7 |

TABLE S2

Faradaic efficiencies and single-pass conversion values for the 8 h long electrolysis at −200 mA $cm^{-2}$ with an inlet $CO_2$ flow rate of 1.25 mL $min^{-1}$.

| | Faradaic Efficiency/% | | | | | | |
|---|---|---|---|---|---|---|---|
| Time/h | $H_2$ | CO | $C_2H_4$ | HCOOH | $C_2H_5OH$ | $C_3H_7OH$ | SPC % |
| 1 | 32.5 | 1.8 | 32.5 | 2.4 | 23 | 1 | 27.2 |
| 2 | 34.1 | 1.7 | 31.4 | 2.1 | 19 | 4.8 | 26.5 |
| 3 | 37.1 | 1.7 | 30.6 | 2.2 | 21.1 | 3.6 | 26.8 |
| 4 | 35.2 | 1.6 | 31 | 2.6 | 21.2 | 3.7 | 27.4 |
| 5 | 36.6 | 1.6 | 30.2 | 2 | 17.3 | 2.8 | 24.4 |
| 6 | 37.1 | 1.6 | 29.7 | 2 | 20.5 | 2.9 | 25.5 |
| 7 | 37.9 | 1.6 | 29.7 | 2 | 18.8 | 3.1 | 24.8 |
| 8 | 38.4 | 1.5 | 29.7 | 2 | 20.2 | 2.9 | 25.3 |

TABLE S3

Amounts of $CO_2$ found in the direct and indirect outlets with the fraction converted to $CO_2R$ products.

| | $CO_2$ in direct outlet (nmol/s) | $CO_2$ in indirect outlet (nmol/s) | $CO_2$ to products (nmol/s) |
|---|---|---|---|
| 0 mA $cm^{-2}$ | 705.7 | 49 | — |
| −200 mA $cm^{-2}$ | 12.4 | 496.4 | 240.1 |

The invention claimed is:

1. Process for electrolysing carbon dioxide, said process is characterized in that it comprises the following steps:

a) providing a system comprising a gas-fed flow cell comprising a gas chamber with a gas inlet, a gas outlet, a catholyte chamber, and a gas diffusion electrode comprising a metal-based catalyst, wherein the gas diffusion electrode is placed between the gas chamber and the catholyte chamber;

b) providing a catholyte flow and an anolyte flow into said gas-fed flow cell;

c) activating said gas-fed flow cell under operating conditions;

d) providing a gas input flow comprising carbon dioxide using the gas inlet of the gas chamber to produce a direct gas stream exiting from the gas outlet of the gas chamber and a liquid catholyte output flow from the catholyte chamber comprising products, wherein said liquid catholyte output flow is degassed in a catholyte reservoir to produce an indirect gas stream exiting from a gas outlet of the catholyte reservoir;

wherein the catholyte flow is an acidic catholyte flow comprising one or more alkali metal cations and in that the gas-fed flow cell comprises a bipolar membrane that includes a cation-exchange layer in contact with the catholyte and an anion-exchange layer in contact with the anolyte; wherein the cation-exchange layer provides protons to the catholyte and the anion exchange layer provides hydroxide ions to the anolyte; in that the acidic catholyte has a pH of between 1.0 to 4.0 and in that the catholyte pH is less than the anolyte pH.

2. The process according to claim 1 is characterized in that the indirect gas stream exiting from the catholyte reservoir comprises carbon dioxide, and in that the process further comprises a step e) of recovering the indirect gas stream exiting from the catholyte reservoir and recycling said indirect gas stream into the gas input flow comprising carbon dioxide of step d).

3. The process according to claim 1 is characterized in that the gas input flow provided in step (d) has a flow rate ranging from 0.5 to 10 mL/min.

4. The process according to claim 1 is characterized in that the acidic catholyte has a pH ranging from 1.1 to 3.5.

5. The process according to claim 1 is characterized in that the anolyte has a pH ranging from 7 to 15.

6. The process according to claim 5 is characterized in that the anolyte has a pH ranging from 10 to 14.

7. The process according to claim 1 is characterized in that the acidic catholyte comprises one or more acids at a concentration ranging from 0.01 to 1.0 M and one or more alkali metal cation donors at a concentration ranging from 1.0 to 5.0 M.

8. The process according to claim 7 is characterized in that the one or more alkali metal cations are one or more selected from $Cs^+$, $K^+$, $Li^+$, and $Na^+$.

9. The process according to claim 1 is characterized in that the acidic catholyte comprises one or more alkali metal cation donors selected from caesium chloride, caesium iodide, caesium sulfate, caesium phosphate, caesium hydroxide, potassium chloride, potassium phosphate monobasic, potassium sulfate, potassium iodide, potassium hydroxide, lithium chloride, lithium iodide, lithium sulfate, lithium phosphate, lithium hydroxide, sodium chloride, sodium sulphate, sodium iodide, sodium phosphate and sodium hydroxide.

10. The process according to claim 9 is characterized in that the one or more alkali metal cation donors at a concentration ranging from 0.5 to 5.0 M.

11. The process according to claim 1 is characterized in that the acidic catholyte comprises one or more acids selected from hydrochloric acid, sulfuric acid, hydrobromic acid, hydriodic acid, perchloric acid, and chloric acid.

12. The process according to claim 11 is characterized in that the one or more acids are present at a concentration ranging from 0.01 to 1.0 M.

13. The process according to claim 1 is characterized in that the metal of the metal-based catalyst is selected from copper, silver and any mixture thereof; and/or the metal-based catalyst is or comprises copper oxide nanoparticles and the process comprises a catalyst activation step to reduce copper oxide to metallic copper.

14. The process according to claim 1 is characterized in that the operating conditions at which the flow cell is operated in step c) comprise current density ranging from −100 mA/$cm^2$ to −1.5 A/$cm^2$.

15. A system (1) suitable to perform the process for electrolysing carbon dioxide according to claim 1, the system comprising a gas-fed flow cell (3) comprising a gas chamber (5), a catholyte chamber (7) and an anolyte chamber (9), wherein said gas chamber (5) is separated from the catholyte chamber (7) by a gas diffusion electrode (17), said gas diffusion electrode (17) having a gas diffusion membrane being comprised within said gas chamber, wherein said catholyte chamber (7) and said anolyte chamber (9) comprise respectively a cathode and an anode, and wherein the system (1) further comprises catholyte (23) and anolyte (25) and means (27; 29) to flow the catholyte (23) and the anolyte (25) within respectively said catholyte chamber (7) and said anolyte chamber (9);

wherein the system is characterized in that the catholyte flow is an acidic catholyte flow comprising one or more alkali metal cations and in that the gas-fed flow cell comprises a bipolar membrane (19) that includes a cation-exchange layer in contact with the catholyte and an anion-exchange layer in contact with the anolyte; wherein the cation-exchange layer provides protons to the catholyte and the anion exchange layer provides hydroxide ions to the anolyte; in that the acidic catholyte has a pH of between 1.0 to 4.0 and in that the catholyte pH is less than the anolyte pH;

and wherein the system (1) further comprises a catholyte reservoir to receive and degas the liquid catholyte output flow exiting the catholyte chamber.

* * * * *